US009819134B2

(12) United States Patent
Virkler et al.

(10) Patent No.: US 9,819,134 B2
(45) Date of Patent: Nov. 14, 2017

(54) TOOL FOR STRIPPING AND CRIMPING A WIRE

(71) Applicant: General Electric Company, Schenectady, NY (US)

(72) Inventors: Adam Eric Virkler, Erie, CO (US); Steven Jackson Foss, Loveland, CO (US); Royce Woodard, Amarillo, TX (US); Julie Elizabeth Steinbrenner, Boulder, CO (US); Davis Haberkorn, Louisville, CO (US); Warren Mitchell, Jr., Lafayette, CO (US); Jamie Curran, Longmont, CO (US); Teller Junak, Lafayette, CO (US); Kathryn David, Seattle, WA (US)

(73) Assignee: General Electric Company, Schenectady, NY (US)

( * ) Notice: Subject to any disclaimer, the term of this patent is extended or adjusted under 35 U.S.C. 154(b) by 288 days.

(21) Appl. No.: 14/633,697

(22) Filed: Feb. 27, 2015

(65) Prior Publication Data

US 2016/0254631 A1 Sep. 1, 2016

(51) Int. Cl.

| | |
|---|---|
| ***H01R 43/04*** | (2006.01) |
| ***B26D 3/28*** | (2006.01) |
| ***H01R 43/042*** | (2006.01) |

(52) U.S. Cl.

CPC ..... *H01R 43/0421* (2013.01); *B26D 3/28* (2013.01)

(58) Field of Classification Search

CPC .. H01R 43/0421; H01R 43/048; H01R 43/05; H01R 43/015; H01R 43/045;

(Continued)

(56) References Cited

U.S. PATENT DOCUMENTS 3,253,451 A 5/1966 Kerns et al.
4,126,936 A 11/1978 Koller (Continued)

FOREIGN PATENT DOCUMENTS

EP 0177205 A2 4/1986
FR 2602617 A1 2/1988

(Continued)

OTHER PUBLICATIONS

Original documnet FR2693045A1 to Robbes is attached.*

(Continued)

*Primary Examiner* — Peter DungBa Vo
*Assistant Examiner* — John S Lowe
(74) *Attorney, Agent, or Firm* — Armstrong Teasdale LLP

(57) ABSTRACT

A tool for stripping and crimping a wire includes a housing. The tool also includes a wire holding system defining a wire holding area and comprising a set of teeth configured to hold the wire as the wire is stripped and crimped. At least a portion of the wire holding system is contained within the housing. The tool further includes a wire stripping system defining a wire stripping area and comprising at least one stripping member configured to penetrate at least a portion of the wire. At least a portion of the wire stripping system is contained within the housing. The wire stripping area is adjacent to the wire holding area. Additionally, the tool includes a lug retainer system configured to position a lug on the wire in the wire stripping area.

11 Claims, 12 Drawing Sheets

(58) Field of Classification Search
CPC .. H01R 43/042; H01R 43/0428; H01R 43/04; B25B 7/12; Y10T 29/53235; Y10T 29/53226; Y10T 29/5193; Y10T 29/53213; Y10T 29/514; Y10T 29/49174
USPC ..... 7/107, 127; 29/753, 748, 564.4, 751, 29/505, 761, 268, 33 M
See application file for complete search history.

(56) References Cited

U.S. PATENT DOCUMENTS

| | | | |
|---|---|---|---|
| 4,451,947 | A | 6/1984 | Frieber |
| 5,414,925 | A | 5/1995 | Nishide et al. |
| 5,500,998 | A | 3/1996 | Schmode et al. |
| 6,279,215 | B1 | 8/2001 | Nomoto |
| 6,351,865 | B1 | 3/2002 | De Donato |
| 8,151,670 | B2 | 4/2012 | Nelson |
| 2003/0097716 | A1 | 5/2003 | Nordlin |

FOREIGN PATENT DOCUMENTS

| | | | | |
|---|---|---|---|---|
| FR | 2693045 | A1 * | 12/1993 | ..... H01R 43/0421 |
| FR | 2704169 | A1 | 10/1994 | |
| GB | 2330108 | A | 4/1999 | |
| JP | 2002124361 | A * | 4/2002 | |

OTHER PUBLICATIONS

Machine translation of FR2693045A1 to Robbes is attached.*
Origina document JP 2002124361 A to Sugitani is attached.*
Machine Translation JP 2002124361 A to Sugitani is attached.*
PCT International Search Report and Written Opinion for related application PCT/US2014/057945 dated Dec. 10 2014; 13 pages.
Self-Adjusting Wire Stripper, Irwin Tools, www.irwin.com/tools/pliers-adjustable-wrenches/self-adjusting-wire-stripper, last accessed Dec. 17, 2014. last.
Multi-Tool Stripper/Crimper/Cutter, Irwin Tools, www.irwin.com/tools/pliers-adjustable-wrenches/multi-tool-stripper-crimper-cutter, last accessed Dec. 17, 2014.
U.S. Appl. No. 14/066,500, filed Oct. 29, 2013, 26 pages.

* cited by examiner

TOOL FOR STRIPPING AND CRIMPING A WIRE

BACKGROUND

The field of the disclosure relates generally to wire stripping and more particularly, to a tool for use in stripping and crimping a wire.

Generally, at least two known tools are used to strip and crimp wires. A first tool is used to strip a wire. A second tool is used to crimp a lug onto the wire. However, using two tools may be burdensome and/or time consuming. Attempts have been made to combine the operations of wire stripping and crimping into a single tool. Generally, such tools have provided only limited benefits. For example, pliers are used to strip and crimp a wire. However, a user of such pliers must use several different motions to strip the wire and then at least one additional maneuver to crimp the wire. More specifically, a user must first cut the insulation of the wire, then pull the wire out of the plier, manually load a lug on the end of the wire, and then the wire can be crimped. Such a process may be time consuming and difficult for a user to perform repeatedly.

As such, it would be desirable to provide a tool that automatically strips and crimps a wire with a high degree of reliability and in a manner that is more efficient and less time consuming than known methods.

BRIEF DESCRIPTION

In one aspect, a tool for stripping and crimping a wire is provided. The tool includes a housing. The tool also includes a wire holding system defining a wire holding area and comprising a set of teeth configured to hold the wire as the wire is stripped and crimped. At least a portion of the wire holding system is contained within the housing. The tool further includes a wire stripping system defining a wire stripping area and comprising at least one stripping member configured to penetrate at least a portion of the wire. At least a portion of the wire stripping system is contained within the housing. The wire stripping area is adjacent to the wire holding area. Additionally, the tool includes a lug retainer system configured to position a lug on the wire in the wire stripping area.

In another aspect, a tool for stripping and crimping a wire is provided. The tool includes a housing. The tool also includes a wire holding system defining a wire holding area and comprising a set of teeth configured to hold the wire as the wire is stripped and crimped. At least a portion of said wire holding system is contained within the housing. The tool further includes a lug retainer system configured to position a lug on the wire in a lug crimping area adjacent to the wire holding area, and a wire crimping system configured to crimp the lug to the wire in the lug crimping area. At least a portion of the wire crimping system is contained within the housing.

In another aspect, a system for stripping and crimping a wire is provided. The system includes a housing. The system also includes a wire stripping system defining a wire stripping area and comprising at least one stripping member configured to penetrate at least a portion of the wire. At least a portion of the wire stripping system is contained within the housing. The system further includes a lug retainer system configured to position a lug on the wire in a lug crimping area that is at least partially co-extensive with the wire stripping area, and a wire crimping system configured to crimp the lug to the wire in the lug crimping area. At least a portion of the wire crimping system is contained within the housing.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings. The singular forms of "a," "an," and "the," include plural references unless the context clearly indicates otherwise. Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Figure 1:
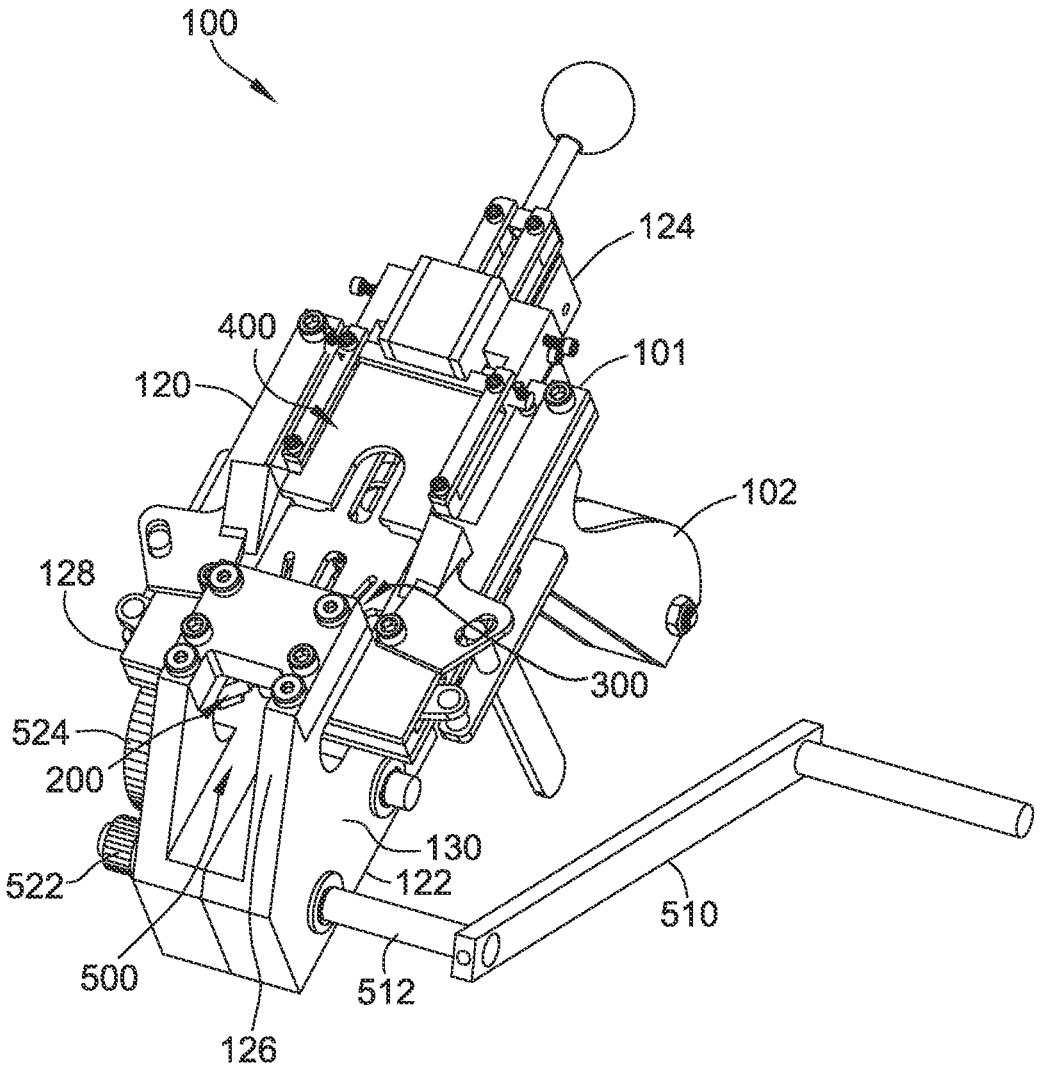
FIG. 1 is a diagram of an exemplary tool that includes at least a portion of an exemplary wire holding system, an exemplary wire stripping system, an exemplary lug retainer system, and an exemplary wire crimping system.

FIG. 1 is a diagram of an exemplary tool 100 that is used to strip and crimp a wire. In the exemplary embodiments, tool 100 includes a housing 101, a wire holding system 200 (shown in detail in FIGS. 2, 3, 4, and 5), a wire stripping system 300 (shown in detail in FIGS. 6, 7, 8, and 9), a lug retainer system 400 (shown in detail in FIGS. 10, 11, and 12), and a wire crimping system 500 (shown in detail in FIGS. 13, 14, and 15). Housing 101 includes a top 120, a bottom 122 opposite top 120, a rear portion 124, a front portion 126 opposite rear portion 124, a first side 128, and a second side 130 opposite first side 128. A handle 102 is coupled to housing 101 proximate housing rear portion 124. In the exemplary embodiment, housing 101 includes at least a portion of each of wire holding system 200, wire stripping system 300, lug retainer system 400, and wire crimping system 500. Wire holding system 200, wire stripping system 300, lug retainer system 400, and wire crimping system 500 are each coupled to one another. Housing 101 is fabricated from at least one of a variety of materials including, but not limited to, aluminum, copper, and steel.

Figure 2:
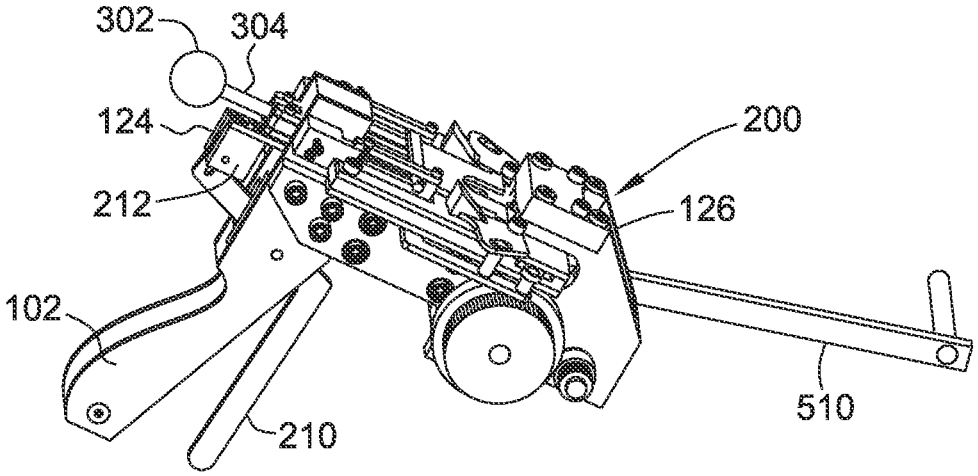
FIG. 2 is a side view of the exemplary tool shown in FIG. 1 with an exemplary embodiment of a transfer member of the wire holding system in a first position.
Figure 3:
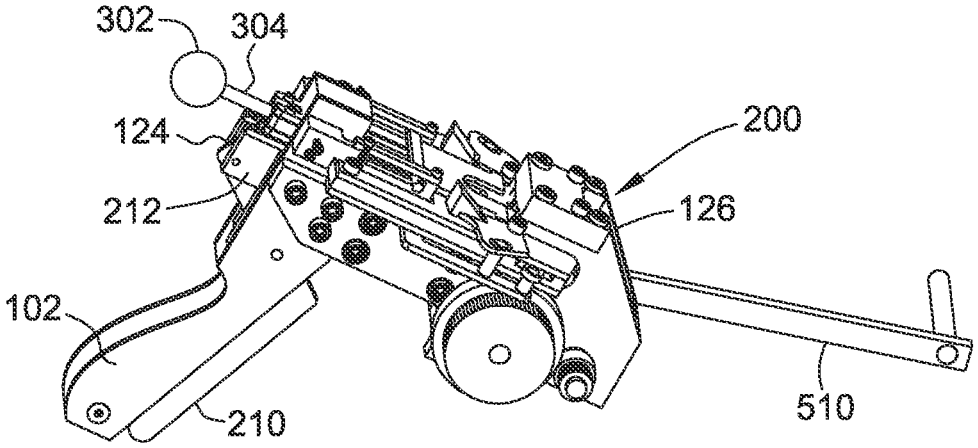
FIG. 3 is a side view of the exemplary tool shown in FIG. 1 with the exemplary transfer member shown in FIG. 2 in a second position.
Figure 4:
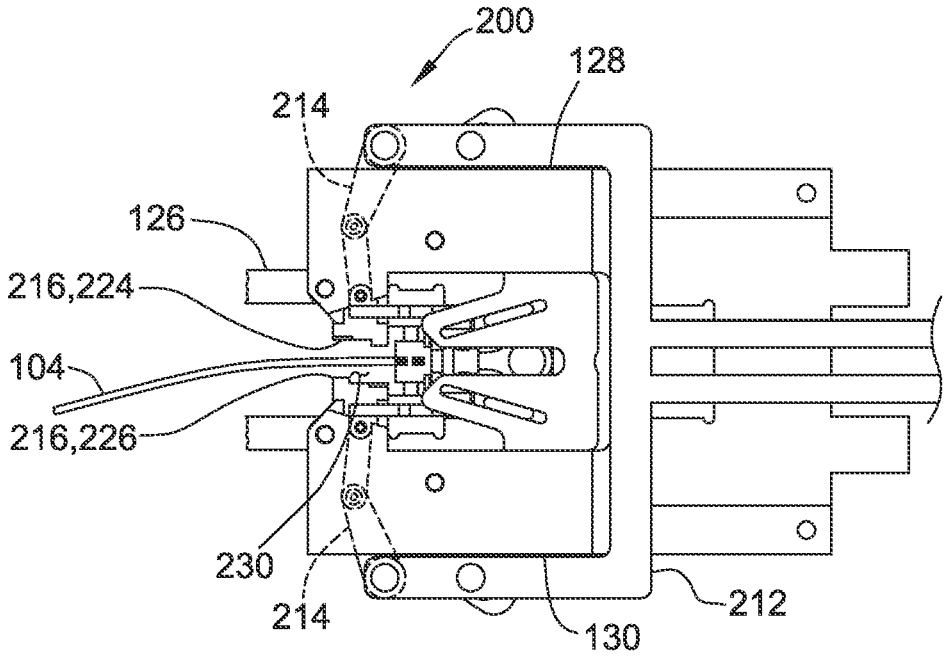
FIG. 4 is a schematic plan view of the exemplary wire holding system of the exemplary tool shown in FIG. 1 with the exemplary transfer member shown in FIG. 2 in the first position.
Figure 5:
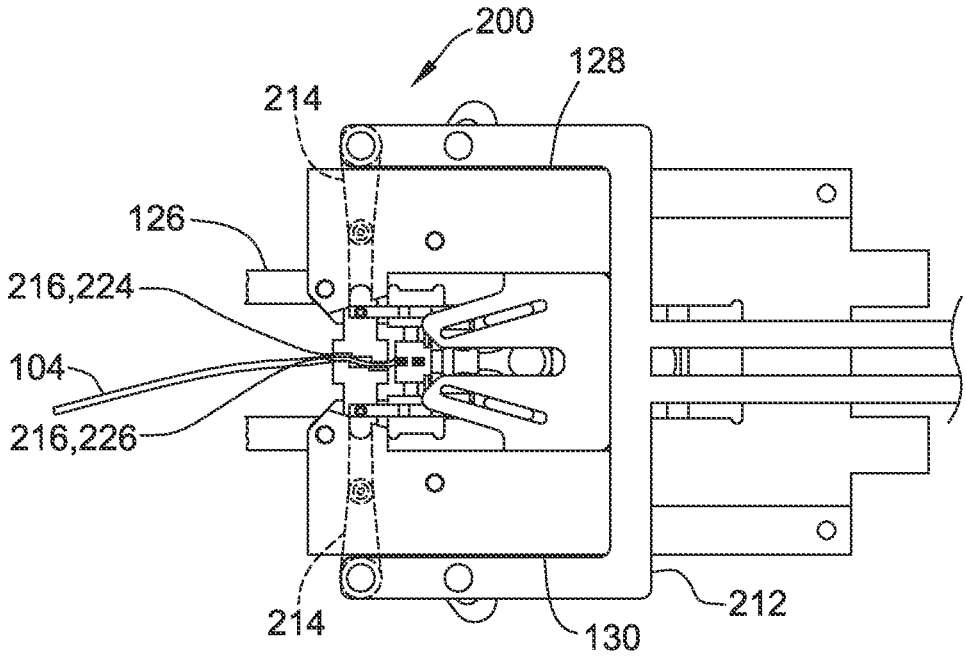
FIG. 5 is a schematic plan view of the exemplary wire holding system of the exemplary tool shown in FIG. 1 with the exemplary transfer member shown in FIG. 2 in the second position.

FIG. 2 is a side view of tool 100 with an exemplary embodiment of a transfer member 212 of wire holding system 200 in a first position. FIG. 3 is a side view of tool 100 with transfer member 212 of wire holding system 200 in a second position. FIG. 4 is a schematic plan view of wire holding system 200 with transfer member 212 in the first position, and FIG. 5 is a schematic plan view of wire holding system 200 with transfer member 212 in the second position. Wire holding system 200 includes a set of teeth 216 that are configured to releasably hold a wire 104 while wire 104 is stripped and crimped by tool 100. Teeth 216 are operably coupled to a trigger 210. In the exemplary embodiment, trigger 210 extends adjacent to handle 102. Trigger 210 is configured such that a user grips handle 102 and trigger 210 with one hand, and squeezes trigger 210 against handle 102 with the one hand to operate wire holding system 200. In alternative embodiments, trigger 210 is any suitable mechanism that enables wire holding system 200 to function as described herein.

In the exemplary embodiment, teeth 216 include a pair of teeth 224 and 226 located adjacent to housing front portion 126. More specifically, teeth 224 and 226 are oppositely disposed about a wire holding area 230. When trigger 210 is in a release position as shown in FIG. 2, teeth 224 and 226 are spaced to receive a tip of wire 104 into wire holding area 230. When trigger 210 is in an operated position as shown in FIG. 3, teeth 224 and 226 converge on wire holding area 230 to clamp wire 104 in place.

In the exemplary embodiment, trigger 210 is operably coupled to teeth 216 through transfer member 212 and a linkage 214. More specifically, transfer member 212 is coupled to trigger 210 such that operation of trigger 210 moves transfer member 212 from the first position forward towards front portion 126 into the second position. Linkage 214 is coupled between transfer member 212 and teeth 216 such that the forward movement of transfer member 212 causes teeth 216 to converge on wire holding area 230. In the exemplary embodiment, linkage 214 is sufficiently flexible to enable a variety of wire gauges to be reliably clamped between teeth 216 when trigger 210 is in the operated position. Further in the exemplary embodiment, transfer member 212 is biased towards rear portion 124 such that, when a user is not actively operating trigger 210, teeth 216 reset to the release position as shown in FIG. 3. In alternative embodiments, trigger 210 is operably coupled to teeth 216 in any suitable fashion that enables wire holding system 200 to function as described herein.

Figure 6:
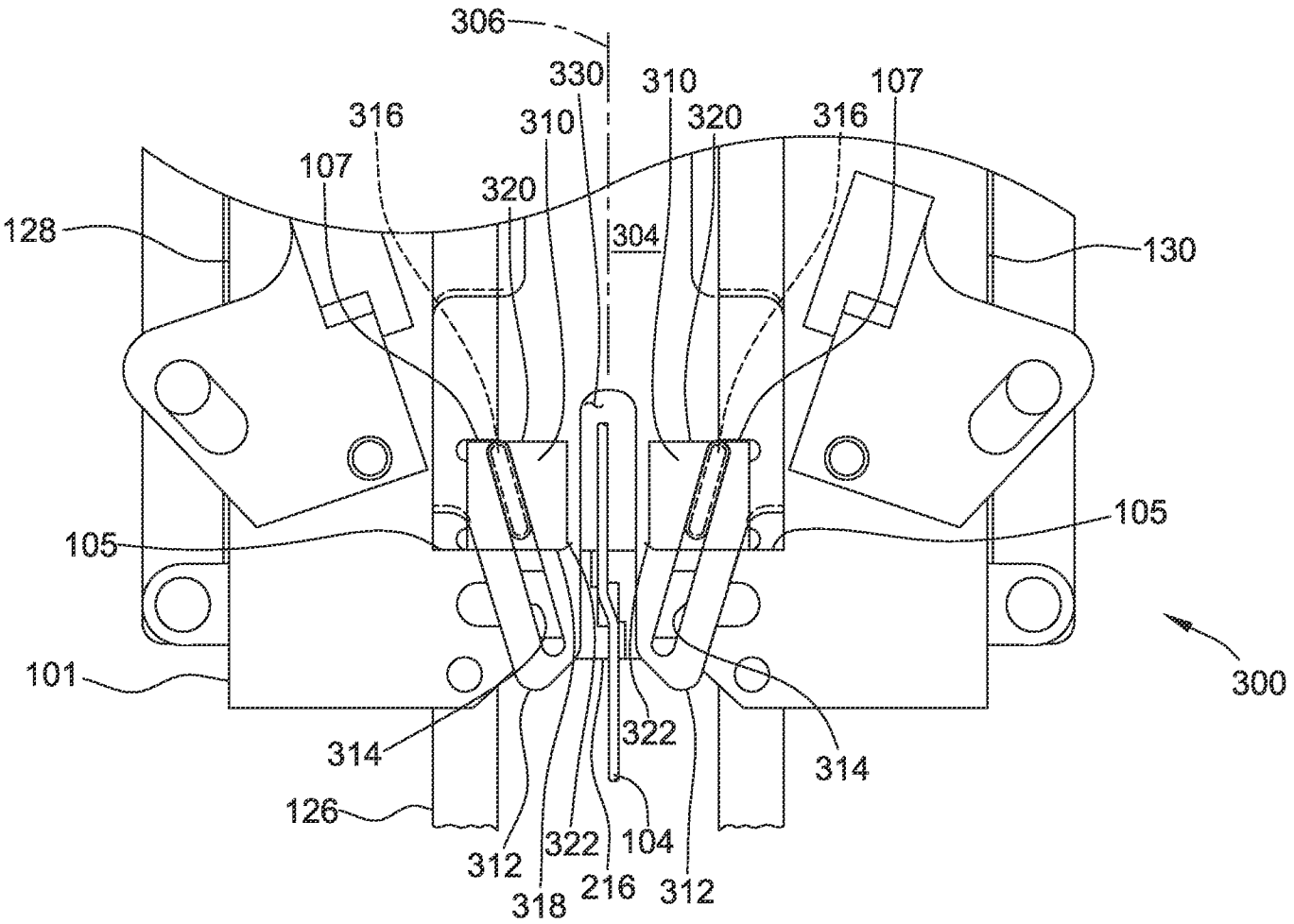
FIG. 6 is a schematic plan view of the exemplary wire stripping system of the exemplary tool shown in FIG. 1 with an exemplary embodiment of a positioning member in a first position.
Figure 7:
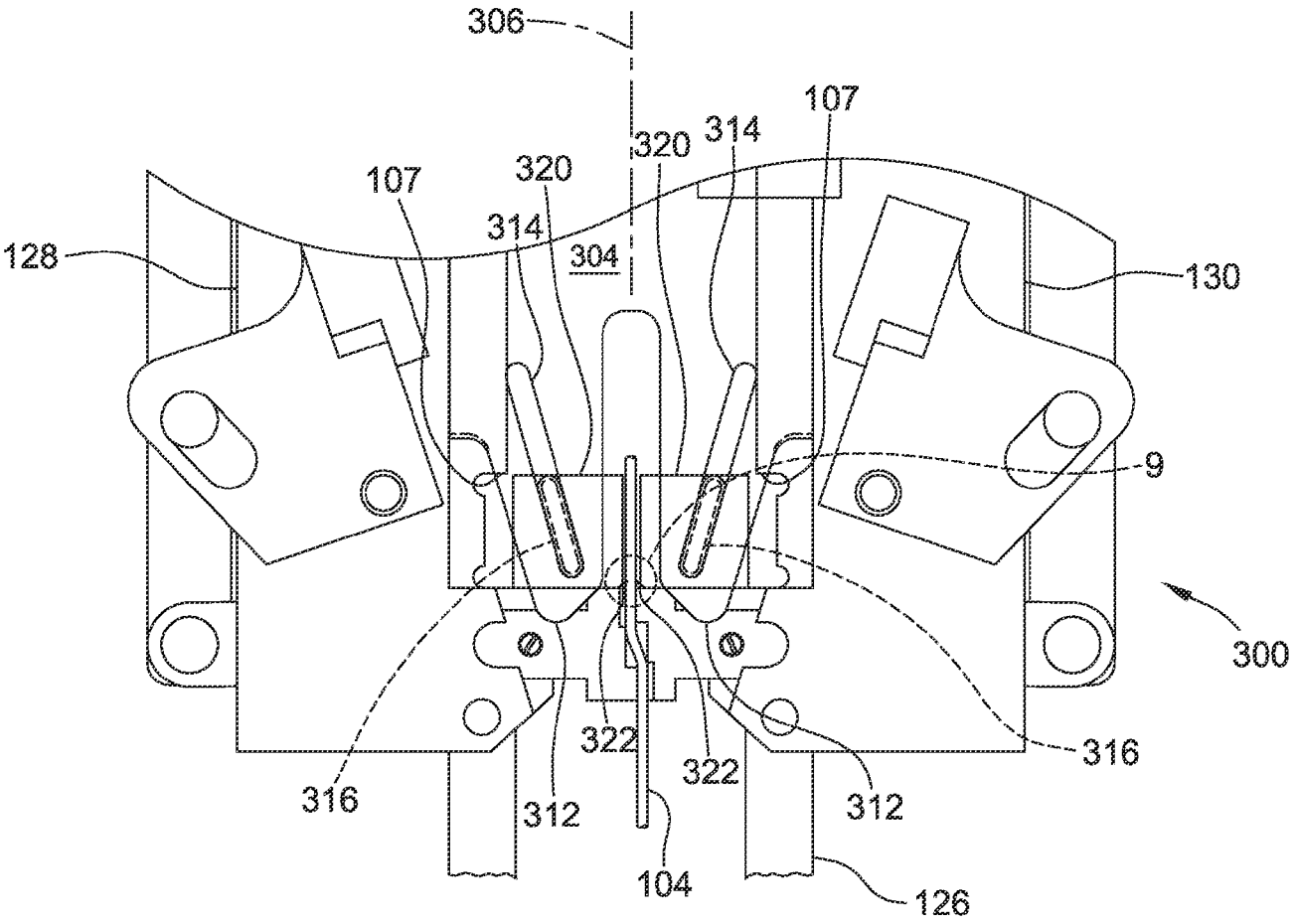
FIG. 7 is a schematic plan view of the exemplary wire stripping system of the exemplary tool shown in FIG. 1 with the exemplary positioning member shown in FIG. 6 in a second position.
Figure 8:
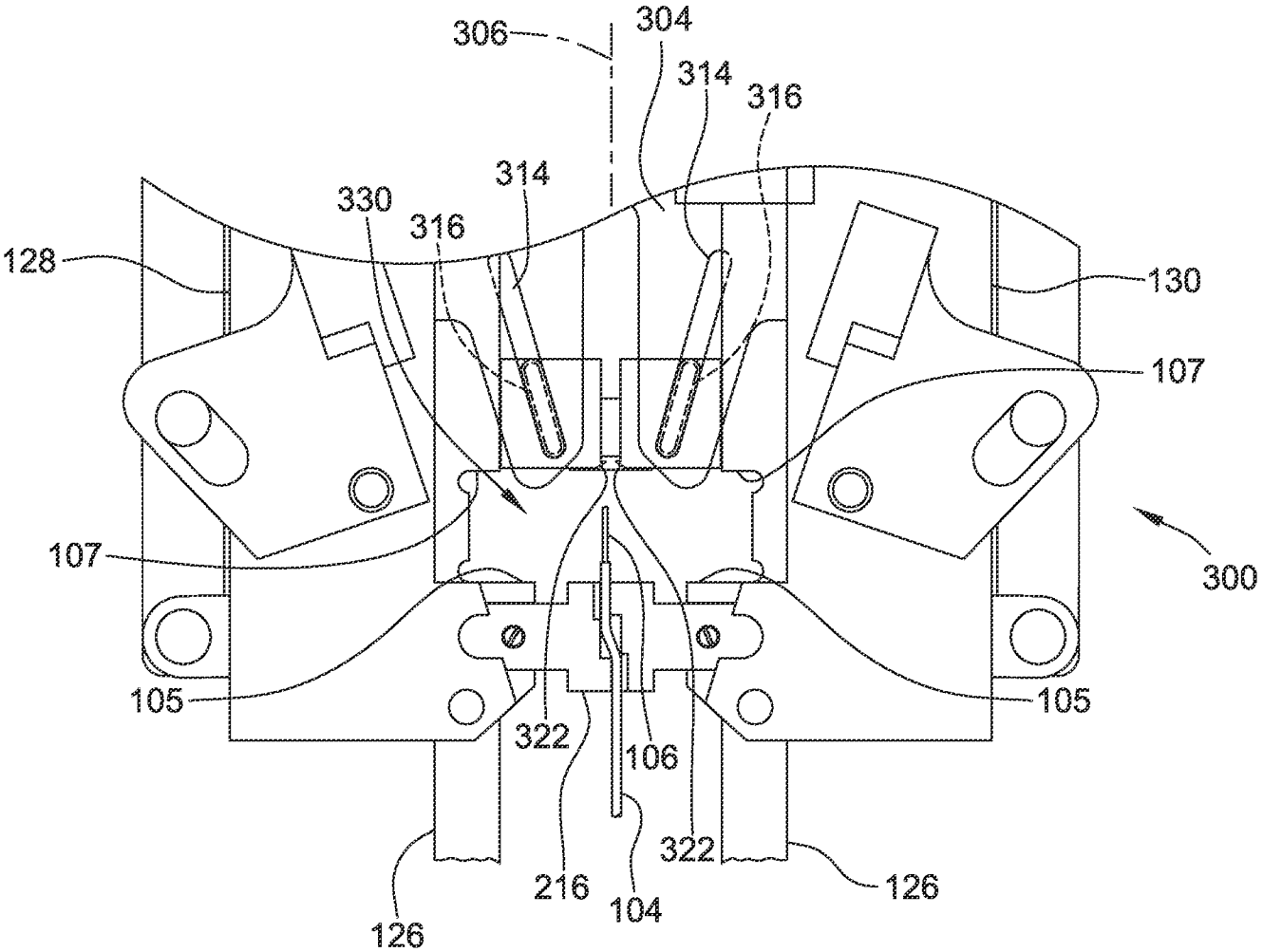
FIG. 8 is a schematic plan view of the exemplary wire stripping system of the exemplary tool shown in FIG. 1 with the exemplary positioning member shown in FIG. 6 in a third position.

FIG. 6 is a schematic plan view of wire stripping system 300 with an exemplary embodiment of a positioning member 304 in a first position. FIG. 7 is a schematic plan view of wire stripping system 300 with positioning member 304 in a second position. FIG. 8 is a schematic plan view of wire stripping system 300 with positioning member 304 in a third position. Wire stripping system 300 is operable to strip an insulated coating from wire 104 when positioning member 304 is operated.

With reference to FIGS. 1 and 6-8, in the exemplary embodiment, wire stripping system 300 includes positioning member 304 operably coupled to at least one stripping member 310 disposed proximate a wire stripping area 330. Wire stripping area 330 is adjacent wire holding area 230, such that a portion of wire 104 to be stripped extends into wire stripping area 330 when wire 104 is clamped in wire holding area 230. In the exemplary embodiment, positioning member 304 extends from proximate front portion 126 to proximate rear portion 124.

In the exemplary embodiment, positioning member 304 includes a grip 302 proximate rear portion 124 and is configured such that, while a user grips handle 102 and trigger 210 with one hand to hold wire 104 securely between teeth 216, the user can move positioning member 304 with the other hand to operate wire stripping system 300. In alternative embodiments, positioning member 304 is configured to be operated in any other suitable fashion.

In the exemplary embodiment, the first position of positioning member 304 is a forward position, the second position of positioning member 304 is an intermediate position, and the third position of positioning member 304 is a rearward position, where the "front" and "rear" directions are defined with respect to housing front portion 126 and housing rear portion 124. In alternative embodiments, positioning member 304 is any suitable mechanism that enables wire stripping system 300 to function as described herein.

In the exemplary embodiment, the at least one stripping member 310 includes a pair of stripping members 310 disposed oppositely across wire stripping area 330. In the exemplary embodiment, each stripping member 310 includes a ripping blade 322 that extends towards wire stripping area 330. When positioning member 304 is in the forward position shown in FIG. 6, stripping members 310 are spaced to receive a tip of wire 104 into wire stripping area 330. As positioning member 304 is moved from the forward position shown in FIG. 6 to the intermediate position shown in FIG. 7, stripping members 310 are configured to converge on wire 104 such that ripping blades 322 penetrate the insulated coating of wire 104. As positioning member 304 is moved from the intermediate position shown in FIG. 7 to the rearward position shown in FIG. 8, ripping blades 322 are configured to strip the insulated coating from wire 104. In alternative embodiments, the at least one stripping member 310 includes any suitable structure that enables wire stripping system 300 to remove the insulated coating from wire 104 when positioning member 304 is operated.

In the exemplary embodiment, positioning member 304 is operably coupled to the at least one stripping member 310 through a plurality of slotted brackets 312. More specifically, brackets 312 are disposed on positioning member 304 proximate housing front portion 126, and a slot 314 is defined in each bracket 312. Each at least one stripping member 310 includes a protrusion 316 configured to be received in a corresponding slot 314. In the embodiment illustrated in FIG. 6, each stripping member is disposed above the corresponding bracket 312 with respect to the view of FIG. 6, and each protrusion 316 extends downward into the corresponding slot 314 with respect to the view of FIG. 6. In the exemplary embodiment, positioning member 304 includes a second set of slotted brackets 312 (not visible in the section views of FIGS. 6-8 but shown, for example, in FIG. 10) disposed above the at least one stripping member 310, and each at least one stripping member 310 includes an additional protrusion 316 that extends upward with respect to the view of FIG. 6 and is configured to be received in a corresponding slot 314 of the second set of brackets 312. In alternative embodiments, positioning member 304 does not include the second set of brackets 312 and the at least one stripping member 310 does not include the additional protrusion 316.

Housing 101 includes a forward stop 105 and a rear stop 107 each configured to cooperate with slots 314 and stripping members 310 to facilitate stripping wire 104. More specifically, each slot 314 is disposed obliquely with respect to a longitudinal axis 306 of positioning member 304, such that a forward portion of each slot 314 is relatively closer to longitudinal axis 306 and a rear portion of each slot 314 is relatively more distant from longitudinal axis 306. When positioning member 304 is moved to the first position, as shown in FIG. 6, a front edge 318 of each stripping member 310 abuts forward stop 105, such that each protrusion 316 is moved to a rearmost position in the corresponding slot 314. Thus, stripping members 310 are spaced to receive a tip of wire 104 into wire stripping area 330. As positioning member 304 is moved along longitudinal axis 306 to the second position, as shown in FIG. 7, a rear edge 320 of each stripping member 310 abuts rear stop 107, such that each protrusion 316 is moved to a forwardmost position in the corresponding slot 314. Thus, stripping members 310 converge on wire stripping area 330.

Figure 9:
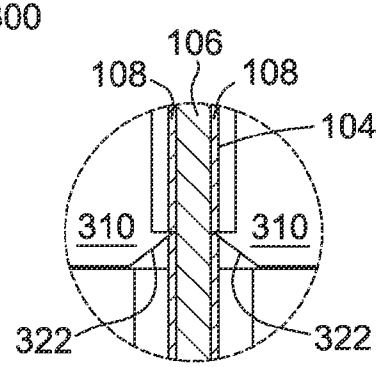
FIG. 9 is a schematic detail view of a portion of FIG. 7.

FIG. 9 is a detail view of a portion of FIG. 7 indicated at 9. As shown in FIG. 9, stripping members 310 are configured to converge within a distance of each other such that ripping blades 322 penetrate substantially into insulation coating 108 of wire 104, but do not substantially penetrate into a conductive core 106 of wire 104.

Returning to FIGS. 1 and 6-8, when each protrusion 316 is moved to the forwardmost position in the corresponding slot 314 as shown in FIG. 7, the obliquity of slot 314 is configured to position stripping members 310 such that rear edge 320 of each stripping member 310 no longer abuts rear stop 107. Thus, as positioning member 304 is moved farther along longitudinal axis 306 to the third position, shown in FIG. 8, stripping members 310 also move along longitudinal axis 306 with positioning member 304 such that ripping blades 322 strip the insulation coating from a longitudinal length of wire 104 and expose the conductive core 106.

Figure 10:
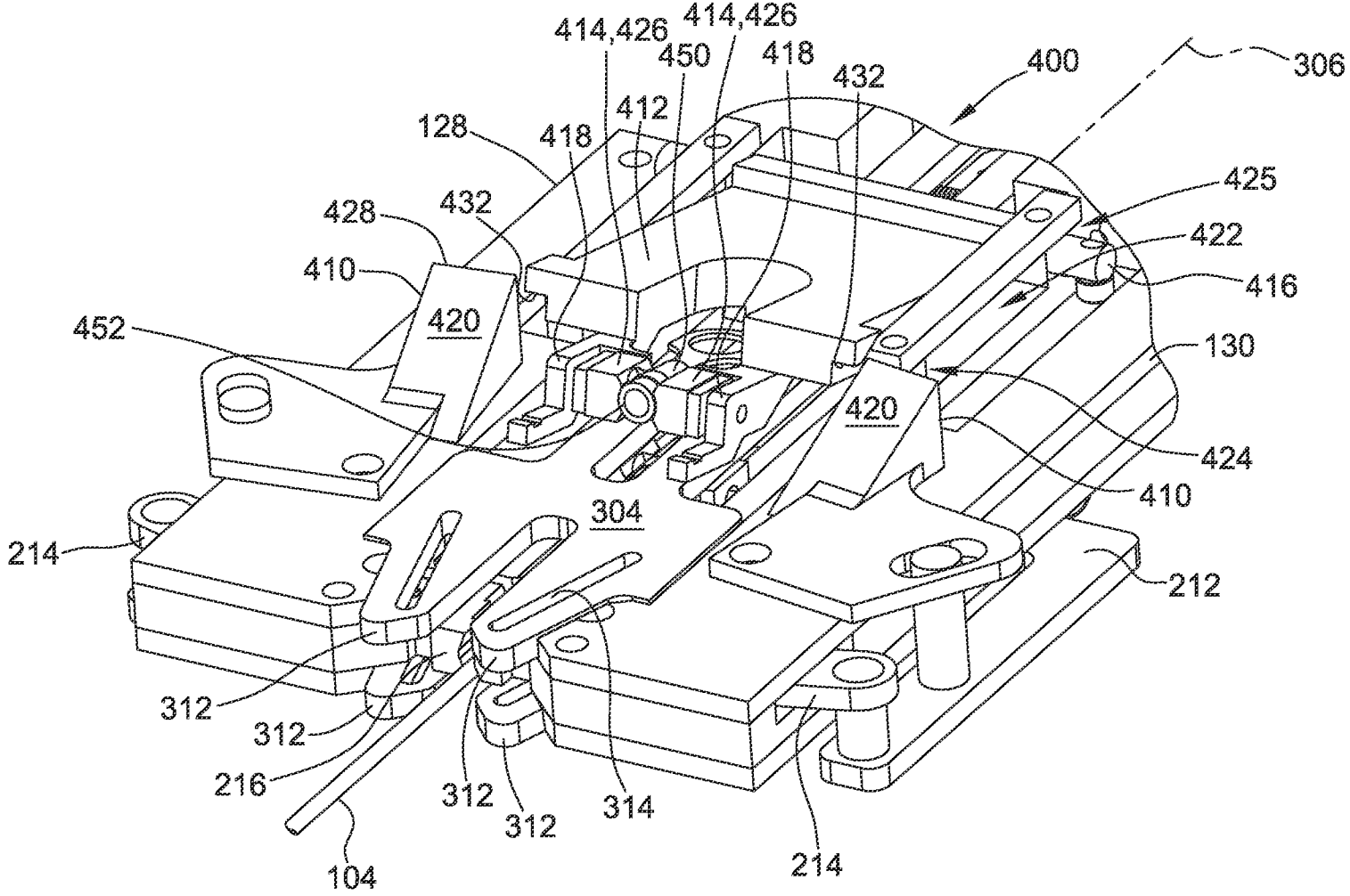
FIG. 10 is a schematic perspective view of the exemplary tool shown in FIG. 1 with an exemplary lug retainer of the exemplary lug retainer system in a first position.
Figure 11:
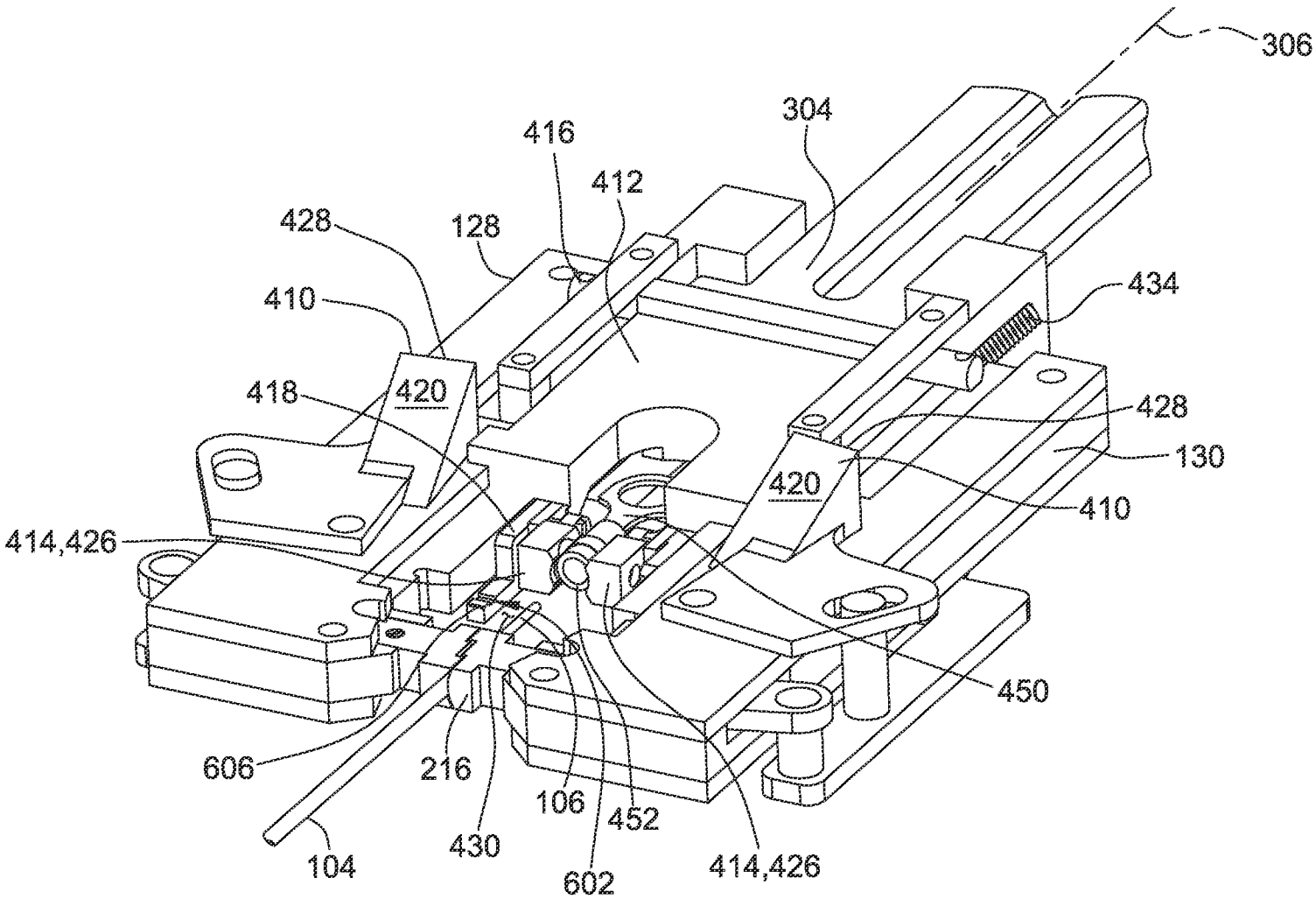
FIG. 11 is a schematic perspective view of the exemplary tool shown in FIG. 1 with the exemplary lug retainer shown in FIG. 10 in a second position.
Figure 12:
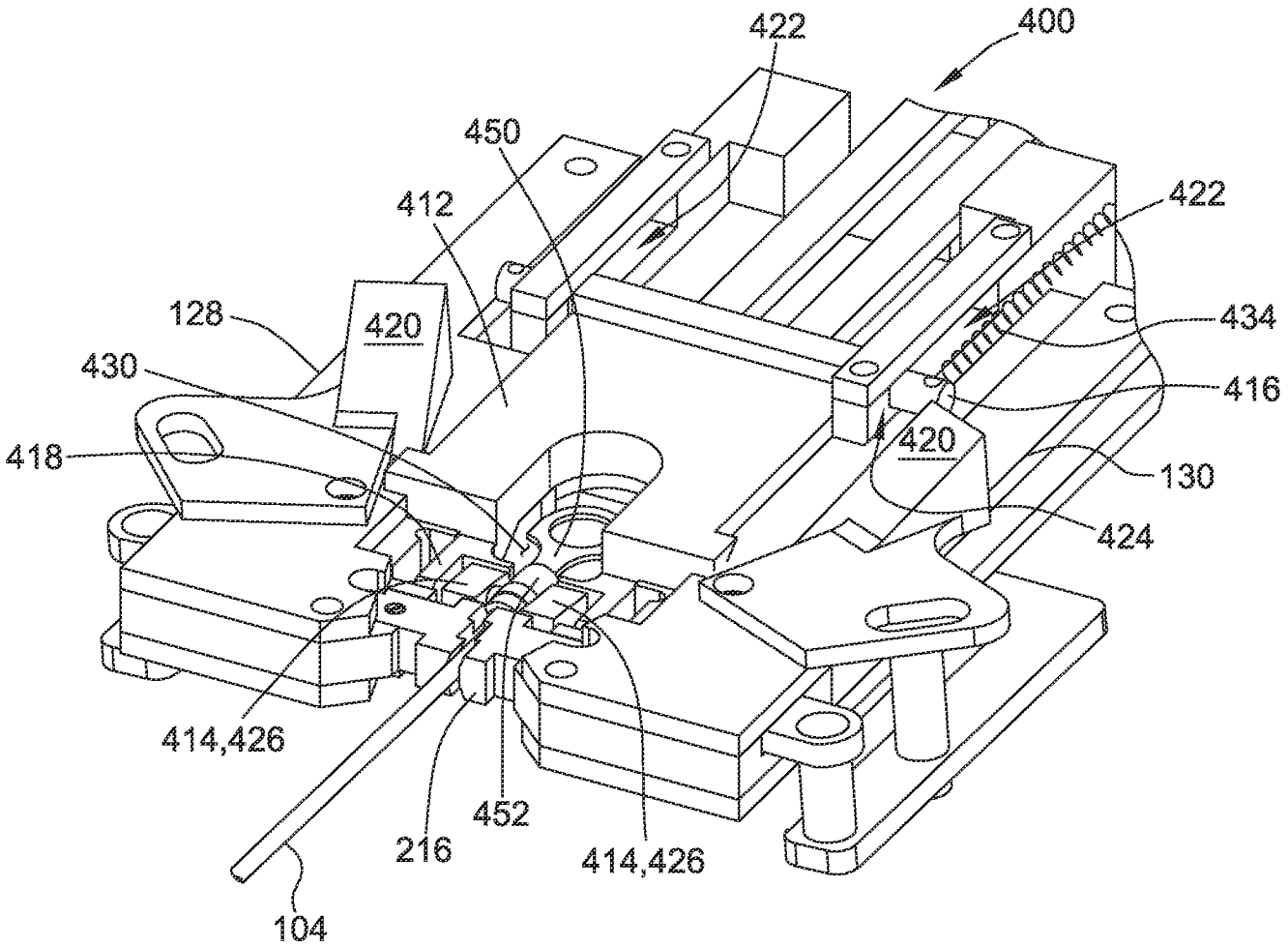
FIG. 12 is a schematic perspective view of the exemplary tool shown in FIG. 1 with the exemplary lug retainer shown in FIG. 10 in a third position.

FIG. 10 is a schematic perspective view of tool 100 with a lug retainer 412 of lug retainer system 400 in a first position. FIG. 11 is a schematic perspective view of tool 100 with lug retainer 412 in a second position. FIG. 12 is a schematic perspective view of tool 100 with lug retainer 412 in a third position. Housing front portion 126 is hidden in FIGS. 10, 11, and 12 for ease of viewing lug retainer system 400. Lug retainer system 400 is operable to position a lug 450 on the portion of wire 104 that has been stripped to expose conductive core 106.

With reference to FIGS. 1 and 10-12, in the exemplary embodiment, lug retainer system 400 includes lug retainer 412 operably coupled to a lug gripper 414 disposed proximate a lug crimping area 430. Lug crimping area 430 is at least partially co-extensive with wire stripping area 330 to facilitate positioning lug 450 on the portion of wire 104 that has been stripped. In the exemplary embodiment, lug retainer 412 is pivotable about an axis member 416 that extends transverse to longitudinal axis 306. Lug retainer 412 is configured such that, while positioning member 304 is between the first and second positions, lug retainer 412 is pivoted into the first position shown in FIG. 10 such that lug retainer system 400 does not obstruct the operation of wire stripping system 300. Lug retainer 412 is further configured such that, when positioning member 304 is moved from the second position into the third position, lug retainer 412 is pivoted into the second position shown in FIG. 11 such that lug retainer system 400 aligns lug 450 with the portion of wire 104 that has been stripped. Lug retainer 412 is further configured such that, when positioning member 304 is returned from the third position at least partially towards the second position, lug retainer 412 is translated along longitudinal axis 306 into the third position shown in FIG. 12 such that lug retainer system 400 positions lug 450 on the portion of wire 104 that has been stripped.

In certain embodiments, the first position of lug retainer 412 is an upper pivoted position. In the exemplary embodiment, for example, an alignment portion 418 of lug retainer 412 is configured to rest atop positioning member 304 such that lug retainer 412 is maintained in the upper pivoted position. In alternative embodiments, tool 100 is configured in another suitable fashion that enables lug retainer 412 to be maintained in the upper pivoted position.

In certain embodiments, the second position of lug retainer 412 is an aligned rearward position, where the "front" and "rear" directions are defined with respect to housing front portion 126 and housing rear portion 124. In the exemplary embodiment, for example, lug retainer 412 is biased, for example by a spring, towards housing 101. Thus, when positioning member 304 is withdrawn to the third position such that lug retainer alignment portion 418 no longer rests atop positioning member 304, lug retainer 412 is biased to pivot towards housing 101 and into the aligned rearward position. In alternative embodiments, tool 100 is configured in another suitable fashion that enables lug retainer 412 to move into the aligned rearward position.

In certain embodiments, the third position of lug retainer 412 is an aligned forward position. In the exemplary embodiment, for example, as positioning member 304 is returned from the third position at least partially towards the second position, brackets 312 couple against lug retainer alignment portion 418, such that lug retainer 412 is translated forward along longitudinal axis 306 with positioning member 304. Further in the exemplary embodiment, each end of axis member 416 is configured to translate along a respective channel 422 defined in housing 101 to facilitate movement of lug retainer 412 from the aligned rearward position to the aligned forward position, and a forward end 424 of channel 422 establishes a limit on the forward translation of lug retainer 412, thus at least partially defining the third position of lug retainer 412. In alternative embodiments, tool 100 is configured in another suitable fashion that enables lug retainer 412 to move from the aligned rearward position to the aligned forward position.

Lug gripper 414 is configured to releasably retain lug 450 in an orientation such that a stem portion 452 of lug 450 at least partially surrounds the portion of wire 104 that has been stripped when lug retainer 412 is moved to the third position. In the exemplary embodiment, lug gripper 414 includes a pair of gripping blocks 426 coupled to lug retainer alignment portion 418 and configured to retain lug 450 therebetween. For example, each gripping block 426 is at least partially formed from a deformable material, such as but not limited to polyurethane, that enables lug 450 to be inserted between gripping blocks 426 and retained there in a releasable friction fit during stripping of wire 104 and positioning and crimping of lug 450. In alternative embodiments, lug gripper 414 is configured in any suitable fashion that enables lug retainer system 400 to function as described herein. In the exemplary embodiment, lug retainer system 400 is configured to enable a user to manually insert lug 450 into lug gripper 414 when lug retainer 412 is in the first position. In alternative embodiments, lug retainer system 400 is configured to enable lug 450 to be inserted into lug gripper 414 in any suitable fashion, including but not limited to in an at least partially automated fashion, that enables lug retainer system 400 to function as described herein.

Figure 13:
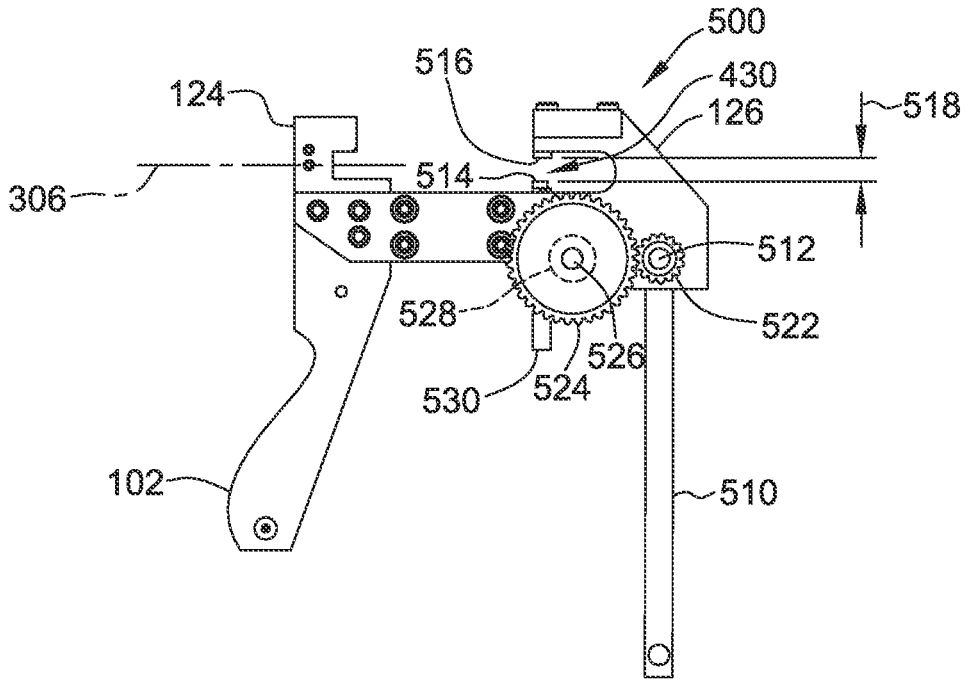
FIG. 13 is a schematic side view of the exemplary tool shown in FIG. 1 with an exemplary lever of the wire crimping system in a first position.
Figure 14:
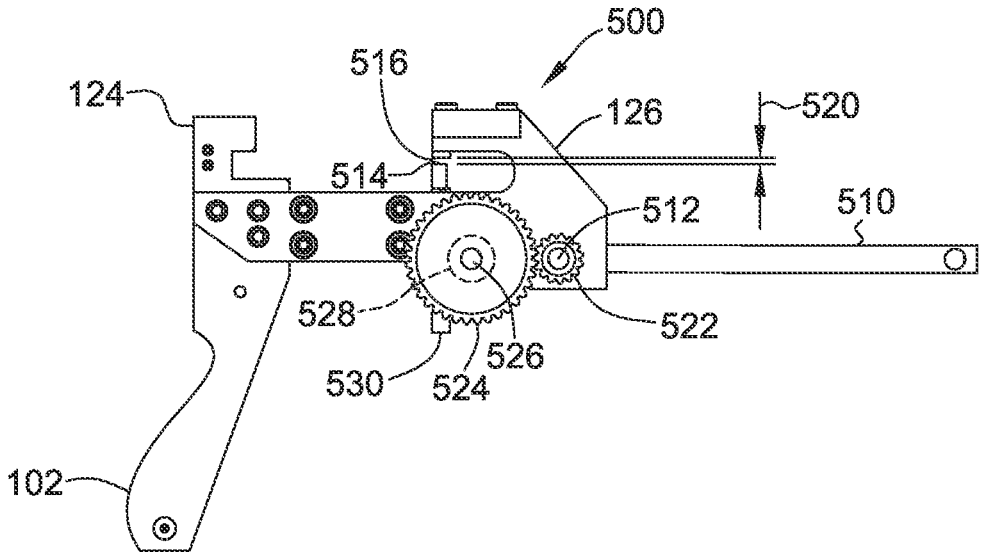
FIG. 14 is a schematic side view of the exemplary tool shown in FIG. 1 with the exemplary lever shown in FIG. 13 in a second position.

FIG. 13 is a schematic side view of tool 100 with a lever 510 of wire crimping system 500 in a first position. FIG. 14 is a schematic side view of tool 100 with lever 510 in a second position. Other aspects of tool 100 are hidden in FIGS. 13 and 14 for ease of viewing wire crimping system 500. Wire crimping system 500 is operable to securely couple lug 450 to conductive core 106 of the portion of wire 104 that has been stripped.

With reference to FIGS. 1, 13, and 14, in the exemplary embodiment, wire crimping system 500 includes lever 510 operably coupled to a first crimping block 514 disposed proximate lug crimping area 430. A second crimping block 516 is disposed opposite first crimping block 514 across lug crimping area 430. Wire crimping system 500 is configured such that, while lever 510 is in the first position shown in FIG. 13, first crimping block 514 is positioned at a relatively long first distance 518 from second crimping block 516, such that wire crimping system 500 does not obstruct the operation of wire stripping system 300 and lug retainer system 400. Wire crimping system 500 is further configured such that, when lever 510 is moved into the second position shown in FIG. 14, first crimping block 514 moves to within a relatively short second distance 520 of second crimping block 516. More specifically, when lug 450 is retained in lug retaining system 400 and lug retainer 412 is in the third position (shown in FIG. 12), first crimping block 514 and second crimping block 516 are configured to couple against opposite sides of stem 452 of lug 450 and deform stem 452 as first crimping block 514 is moved within second distance 520 of second crimping block 516, such that lug 450 is securely coupled to conductive core 106 on the portion of wire 104 that has been stripped.

In the exemplary embodiment, lever 510 is configured such that, while a user grips handle 102 and trigger 210 with one hand to hold wire 104 securely between teeth 216, the user can move lever 510 with the other hand to operate wire crimping system 500. In alternative embodiments, lever 510 is configured to be operated in any other suitable fashion.

In the exemplary embodiment, lever 510 is rigidly coupled to, and reversibly rotatable between the first position and the second position about, a first axis member 512 that extends transverse to longitudinal axis 306. For example, first axis member 512 is rotatably coupled to housing front portion 126. Although the first position of lever 510 is shown as vertical and the second position of lever 510 is shown as horizontal in FIGS. 13 and 14, it should be understood that wire crimping system 500 is alternatively configurable such that the first and second positions each have any orientation. In the exemplary embodiment, a first spur gear 522 also is rigidly coupled to first axis member 512. First spur gear 522 is in geared communication with a second spur gear 524. In the exemplary embodiment, first spur gear 522 and second spur gear 524 are configured to multiply a force applied by a user to lever 510. For example, in the exemplary embodiment, first spur gear 522 is a 15-tooth gear and second spur gear 524 is a 48-tooth gear. In alternative embodiments, first spur gear 522 and second spur gear 524 have any configuration that enables wire crimping system 500 to function as described herein.

Further in the exemplary embodiment, second spur gear 524 is rigidly coupled to a second axis member 526 that extends substantially parallel to first axis member 512. A third spur gear 528 also is rigidly coupled to second axis member 526. Third spur gear 528 is in geared communication with a rack 530. First crimping block 514 is disposed on an end of rack 530 proximate lug crimping area 430. Thus, a force applied to lever 510 is transmitted (and, in certain embodiments, multiplied) through first axis member 512, first spur gear 522, second spur gear 524, second axis member 526, third spur gear 528, and rack 530 to first crimping block 514 for application to stem 452 of lug 450 (shown in FIG. 12). In alternative embodiments, lever 510 is operably coupled to first crimping block 514 in any suitable fashion that enables wire crimping system 500 to function as described herein.

Figure 15:
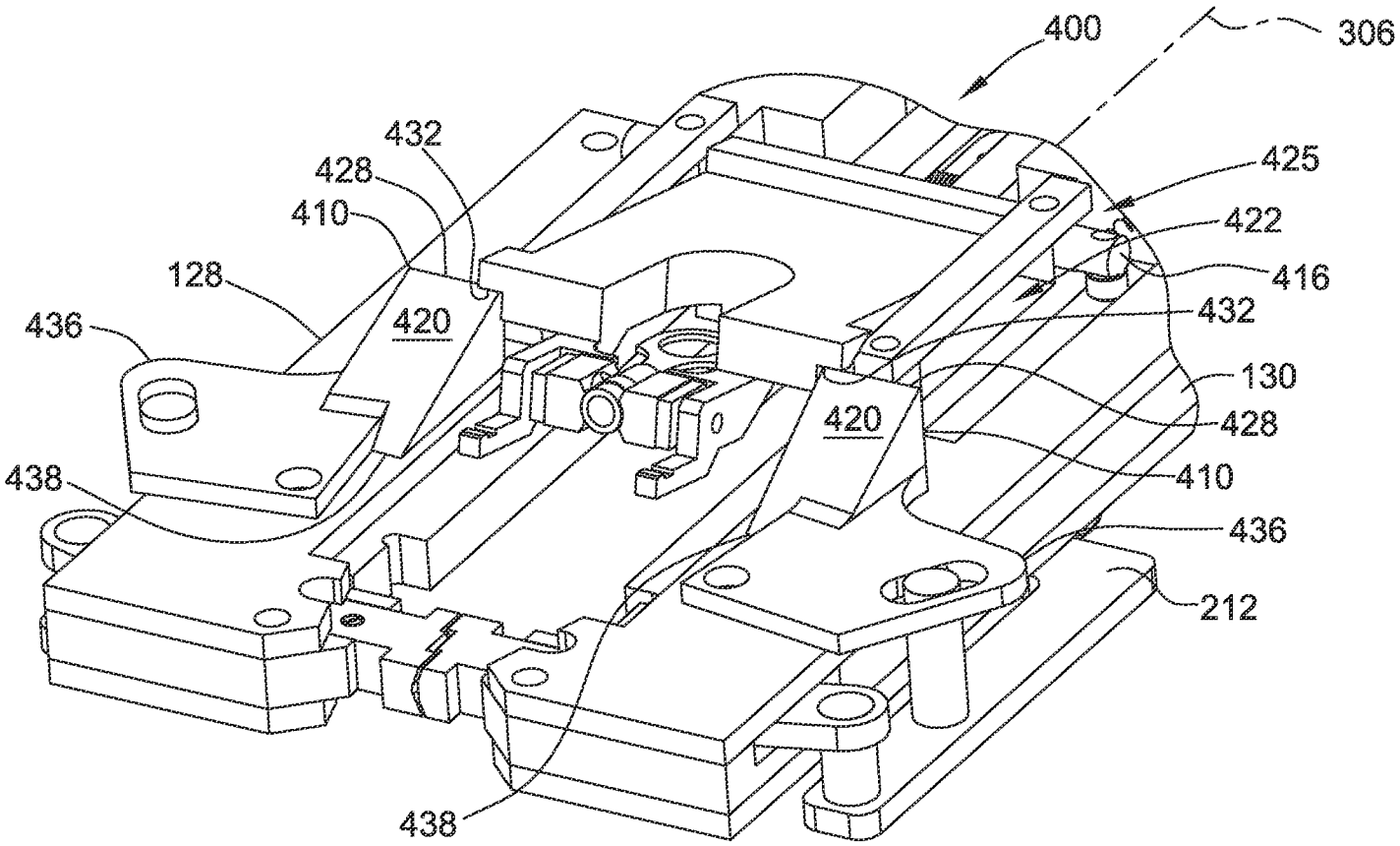
FIG. 15 is a schematic perspective view of the exemplary tool shown in FIG. 1 with an exemplary support of the exemplary lug retainer system in a first position.

FIG. 15 is a schematic perspective view of tool 100 with an exemplary support 410 of lug retainer system 400 in a first position. Housing front portion 126 is hidden in FIG. 15 for ease of viewing lug retainer system 400. Support 410 is coupled to housing 101 for movement between a first position, shown in the exemplary embodiment in FIG. 15, and a second position, shown in the exemplary embodiment in FIG. 11. In the first position, support 410 is configured to facilitate returning lug retainer 412 from the third position of lug retainer 412, shown in FIG. 12, to the first position of lug retainer 412, shown in FIGS. 10 and 15. In the second position, support 410 is configured to enable lug retainer 412 to move from the first position of lug retainer 412 to the second position of lug retainer 412, shown in FIG. 11.

In the exemplary embodiment, support 410 includes a pair of supports 410 each pivotably coupled to housing 101 proximate first side 128 and second side 130, respectively. In addition, each support 410 is operably coupled to transfer member 212 such that when transfer member 212 is in the first position of transfer member 212 shown in FIGS. 4 and 15, each support 410 is in the first position, and when transfer member 212 is in the second position of transfer member 212 shown in FIGS. 5 and 11, each support 410 is in the second position. For example, each support 410 is coupled to transfer member 212 via a respective pivot linkage 436. Thus, in the exemplary embodiment, operation of trigger 210 by a user to hold wire 104 in teeth 216 simultaneously operates to move support 410 from the first position to the second position. In alternative embodiments, support 410 is operable using any suitable structure that enables support 410 to function as described herein.

More specifically in the exemplary embodiment, each support 410 is configured such that in the first position of support 410, as shown in FIG. 15, at least a portion of a sloped surface 420 of support 410 is aligned, in a direction parallel to longitudinal axis 306, with a bearing surface 432 of lug retainer 412.

In certain embodiments, tool 100 is configured to be reset after lug 450 is securely coupled to wire 104. For example, with reference to FIGS. 6-15, in the exemplary embodiment, lug gripper 414 is configured to releasably retain lug 450, as described above. In the exemplary embodiment, first crimping block 514 is configured to slightly move lug 450 in a direction perpendicular to longitudinal axis 306 as first crimping block 514 approaches within second distance 520 of second crimping block 516, such that lug gripper 414 releases lug 450 as the crimping operation occurs. After lug 450 is securely coupled to wire 104, lever 510 is returned from the second position shown in FIG. 14 to the first position shown in FIG. 13, such that first crimping block 514 uncouples from lug stem 452. A user then draws positioning member 304 rearward along longitudinal axis 306 towards the third position shown in FIG. 8, uncoupling brackets 312 from lug retainer alignment portion 418. Thus, lug retainer 412 has an unobstructed path to return rearward along longitudinal axis 306 from the third position of lug retainer 412, shown in FIG. 12, toward the first position of lug retainer 412, shown in FIG. 10.

As lug retainer 412 moves rearward along longitudinal axis 306, a bearing surface 432 of lug retainer 412 is configured to engage sloped surface 420 at a front edge 438 of each support 410. As lug retainer 412 continues to move rearward along longitudinal axis 306, sloped surface 420 urges bearing surface 432 upward, thereby pivoting lug retainer 412 about axis member 416 as axis member 416 travels rearward along channels 422. A rearward end 425 of channel 422 establishes a limit on the rearward translation of lug retainer 412, thus at least partially defining the first position of lug retainer 412.

Also in the exemplary embodiment, when lug retainer 412 reaches the first position, bearing surface 432 rests atop a rear edge 428 of each support 410. When a user operates trigger 210 to begin the next wire crimping operation, transfer member 212 moves support 410 into the second position shown in FIG. 11, thus enabling lug retainer 412 to move into the second position and the third position as described above. In alternative embodiments, support 410 has any suitable structure that facilitates returning lug retainer 412 to the first position as described herein.

In certain embodiments, lug retainer 412 is biased rearward to facilitate an automatic return from the third position of lug retainer 412 to the first position of lug retainer 412. For example, in the exemplary embodiment, as best seen in FIGS. 11 and 12, a respective spring 434 is coupled between axis member 416 and housing 101 proximate each side 128 and 130. As brackets 312 urge lug retainer alignment portion 418 forward such that lug retainer 412 moves into the third position, springs 434 exert a rearward return force on lug retainer 412. As a user draws positioning member 304 rearward along longitudinal axis 306 after the crimping operation is completed, springs 434 cause lug retainer 412 to move rearward and cooperate with support 410 to return lug retainer 412 to the first position. In alternative embodiments, lug retainer 412 is biased rearward using another suitable structure that enables lug retainer 412 to function as described herein. In other alternative embodiments, lug retainer 412 is not biased rearward, and, for example, a user manually returns lug retainer 412 to the first position to reset tool 100 after lug 450 is securely coupled to wire 104.

Figure 16:
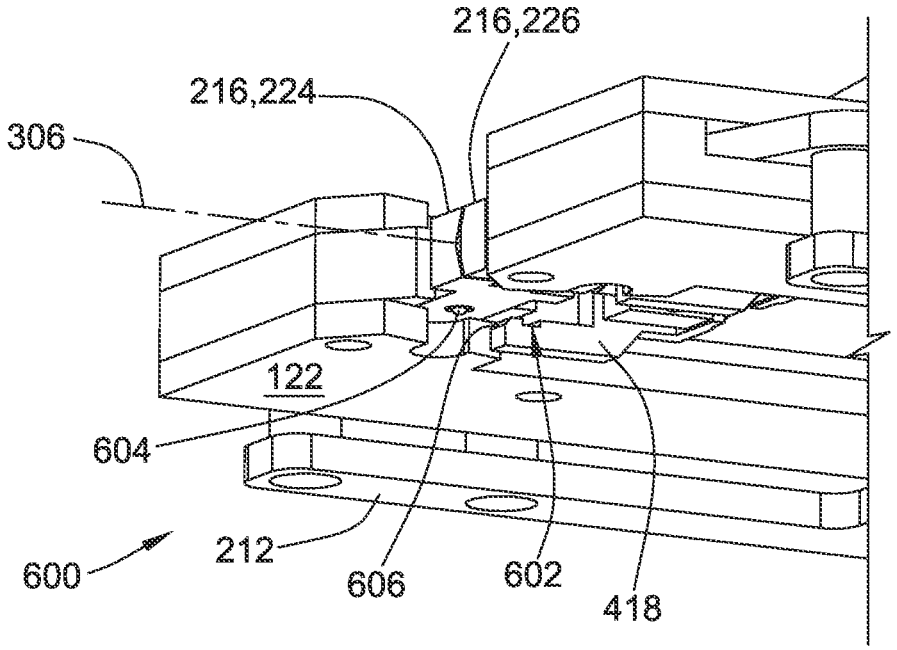
FIG. 16 is a first schematic perspective view of an exemplary stabilizing mechanism of the exemplary tool shown in FIG. 1.
Figure 17:
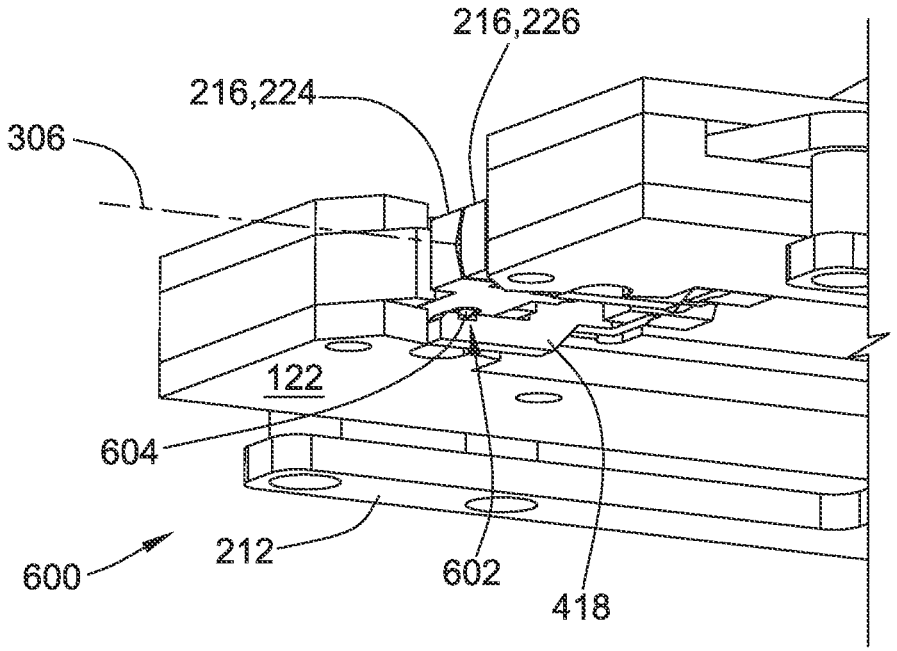
FIG. 17 is a second schematic perspective view of an exemplary stabilizing mechanism of the exemplary tool shown in FIG. 1

FIG. 16 is a first schematic perspective view of an exemplary stabilizing mechanism 600 of tool 100, and FIG. 17 is a second schematic perspective view of stabilizing mechanism 600. Housing front portion 126 is hidden in FIGS. 16 and 17 for ease of viewing stabilizing mechanism 600.

In certain embodiments, stabilizing mechanism 600 facilitates stabilizing lug retainer 412 in the third position during the crimping operation. In the exemplary embodiment, for example, lug retainer 412 includes a detent 602 configured to cooperate with a ball nose spring plunger 604 disposed on tool 100 to facilitate holding lug retainer 412 in the third position of lug retainer 412. More specifically, detent 602 is located on a forward portion of lug retainer alignment portion 418, proximate a beveled forward edge 606 of lug retainer alignment portion 418.

Further in the exemplary embodiment, ball nose spring plunger 604 is disposed on one of teeth 216. Although ball nose spring plunger 604 is illustrated as being disposed on tooth 224, alternatively ball nose spring plunger 604 is disposed on tooth 226. Detent 602 and ball nose spring plunger 604 are aligned in a direction parallel to longitudinal axis 306 such that, as lug retainer 412 approaches the third position of lug retainer 412, as shown in FIG. 16, beveled forward edge 606 depresses ball nose spring plunger 604 such that ball nose spring plunger 604 is flush with a surface of tooth 224. As lug retainer 412 is moved into the third position of lug retainer 412, as shown in FIG. 17, ball nose spring plunger 604 re-emerges from under the surface of tooth 224 into detent 602, and engages detent 602 such that lug retainer 412 is securely coupled to teeth 216. In certain embodiments, the coupling of lug retainer 412 and teeth 216 during the crimping operation provides an increased stability to lug retainer 412. Additionally or alternatively, the coupling of lug retainer 412 and teeth 216 during the crimping operation enables a user to withdraw positioning member 304 such that brackets 312 uncouple from lug retainer alignment portion 418 before the crimping operation is completed, without causing a return of lug retainer 412 to the first position.

In alternative embodiments, detent 602 and ball nose spring plunger 604 are disposed in any suitable location on tool 100 that enables stabilizing mechanism 600 to function as described herein. In other alternative embodiments, stabilizing mechanism 600 includes any additional or alternative structure other than detent 602 and ball nose spring plunger 604 that enables stabilizing mechanism 600 to function as described herein.

In the exemplary embodiment, after the crimping operation is completed, a user releases trigger 210, which causes teeth 216 to separate in a direction transverse to longitudinal axis 306, as described above. As a result, ball nose spring plunger 604 slides in the transverse direction such that ball nose spring plunger 604 disengages from detent 602, uncoupling lug retainer 412 from teeth 216. In alternative embodiments, detent 602 and ball nose spring plunger 604 are configured to be disengaged after the crimping operation in any suitable fashion that enables stabilizing mechanism 600 to function as described herein.

In certain embodiments, each of wire holding system 200, wire stripping system 300, lug retainer system 400, and wire crimping system 500 is configured to operate on wires having a range of wire gauges. For example, in some embodiments, each of wire holding system 200, wire stripping system 300, lug retainer system 400, and wire crimping system 500 is configured to operate on wires having a gauge in the range of AWG 14-18 (wherein "AWG" is American Wire Gauge). In other embodiments, each of wire holding system 200, wire stripping system 300, lug retainer system 400, and wire crimping system 500 is configured to operate on wires having a gauge in the range of AWG 10-13. In still other embodiments, each of wire holding system 200, wire stripping system 300, lug retainer system 400, and wire crimping system 500 is configured to operate on wires having a gauge in the range of AWG 19-24. In alternative embodiments, each of wire holding system 200, wire stripping system 300, lug retainer system 400, and wire crimping system 500 is configured to operate on wires having a gauge in any suitable range that enables tool 100 to function as described herein.

The above described embodiments of a tool, system, and methods enable time-efficient stripping and crimping of a wire. Specifically, the embodiments described herein enable a user to strip a wire, automatically position a lug on the stripped portion of the wire, and crimp the lug to the wire with one tool.

An exemplary technical effect of the methods and systems described herein includes at least one of, without limitation, (a) holding a wire; (b) stripping the wire; (c) loading a lug onto the wire; (d) crimping the lug on the wire; and (e) performing more than one of the operations in (a)-(d) with a single tool and without a need to release the wire from, or reposition the wire within, the holding mechanism between each such operation, thus reducing a time required for stripping and crimping the wire.

Exemplary embodiments of tools, systems, and methods for stripping and crimping a wire are not limited to the specific embodiments described herein, but rather, components of tools, systems, and/or steps of the methods may be utilized independently and/or separately from other components and/or steps described herein. Although specific features of various embodiments of the disclosure may be shown in some drawings and not in others, this is for convenience only. In accordance with the principles of the disclosure, any feature of any drawing may be referenced and/or claimed in combination with any feature of any other drawing.

This written description uses examples to disclose the embodiments, including the best mode, and also to enable any person skilled in the art to practice the embodiments, including making and using any tools or systems and performing any incorporated methods. The patentable scope of the disclosure is defined by the claims, and may include other examples that occur to those skilled in the art. Such other examples are intended to be within the scope of the claims if they have structure elements that do not differ from the literal language of the claims, or if they include equivalent structural elements with insubstantial differences from the literal language of the claims.

What is claimed is:

1. A tool for stripping and crimping a wire, said tool comprising:

a housing;

a wire holding system defining a wire holding area and comprising a trigger engageable set of teeth configured to hold the wire as the wire is stripped and crimped, at least a portion of said wire holding system contained within said housing;

a wire stripping system defining a wire stripping area and comprising at least one stripping member configured to penetrate at least a portion of the wire, operable by a positioning member, at least a portion of said wire stripping system contained within said housing;

a lug retainer system configured to position a lug on the wire in a lug crimping area adjacent to said wire holding area, said lug retainer system comprising a lug gripper configured to releasably retain the lug, at least a portion of said lug retainer system contained within said housing, said lug gripper comprising a pair of gripping blocks coupled to a lug retainer alignment portion for retaining the lug therebetween in a friction fit; and a wire crimping system comprising a lever coupled to a first crimping block, said wire crimping system configured to crimp the lug to the wire in said lug crimping area, at least a portion of said wire crimping system contained within said housing, wherein said lug gripper is configured to release the lug as said first crimping block crimps the lug after an operator selected change in position of said lever.

2. The tool in accordance with claim 1, wherein said housing is defined by a front portion, an opposite rear portion, a top, an opposite bottom, a first side extending between said front and rear portions, and a second side opposite said first side and extending between said front and rear portions.

3. The tool in accordance with claim 1, wherein said wire crimping system further comprises a plurality of gears operably coupled between said lever and said first crimping block.

4. The tool in accordance with claim 1, wherein said pair of gripping blocks are at least partially formed from a deformable material.

5. A system for stripping and crimping a wire, said system comprising:

a housing;

a wire holding system defining a wire holding area and comprising a trigger engageable set of teeth configured to hold the wire as the wire is stripped and crimped, at least a portion of said wire holding system contained within said housing;

a wire stripping system defining a wire stripping area and comprising at least one stripping member configured to penetrate at least a portion of the wire, operable by a positioning member, at least a portion of said wire stripping system contained within said housing;

a lug retainer system configured to position a lug on the wire in a lug crimping area that is at least partially co-extensive with said wire stripping area, said lug retainer system comprising a lug gripper configured to releasably retain the lug, said lug gripper comprising a pair of gripping blocks coupled to a lug retainer alignment portion for retaining the lug therebetween in a friction fit; and a wire crimping system comprising a lever coupled to a first crimping block, said wire crimping system configured to crimp the lug to the wire in said lug crimping area, at least a portion of said wire crimping system contained within said housing, wherein said lug gripper is configured to release the lug as said first crimping block crimps the lug.

6. The system in accordance with claim 5, wherein said housing is defined by a front portion, an opposite rear portion, a top, an opposite bottom, a first side extending between said front and rear portions, and a second side opposite said first side and extending between said front and said rear portions.

7. The system in accordance with claim 5, wherein said lug retainer system is configured to move from a first position to a second position automatically upon operation of said wire stripping system.

8. The system in accordance with claim 5, wherein said wire stripping system further comprises a plurality of brackets, each bracket of said plurality of brackets comprises at least one slot defined therein.

9. The system in accordance with claim 8, wherein said at least one stripping member comprises at least one protrusion configured to be received in a corresponding one of said slots.

10. The system in accordance with claim 5, wherein said wire crimping system further comprises a plurality of gears operably coupled between said lever and said first crimping block.

11. The system in accordance with claim 5, wherein said pair of gripping blocks are at least partially formed from a deformable material.

* * * * *